US011292681B2

(12) United States Patent
Ogawa

(10) Patent No.: US 11,292,681 B2
(45) Date of Patent: Apr. 5, 2022

(54) SHEET FEED DEVICE FOR RESTRICTING NOISE GENERATION, IMAGE FORMING APPARATUS

(71) Applicant: KYOCERA Document Solutions Inc., Osaka (JP)

(72) Inventor: Naozumi Ogawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 258 days.

(21) Appl. No.: 16/711,075

(22) Filed: Dec. 11, 2019

(65) Prior Publication Data

US 2020/0198909 A1 Jun. 25, 2020

(30) Foreign Application Priority Data

Dec. 19, 2018 (JP) ..... JP2018-236956

(51) Int. Cl.
*B65H 3/52* (2006.01)
*B65H 3/06* (2006.01)
*B65H 3/56* (2006.01)

(52) U.S. Cl.
CPC ..... *B65H 3/5223* (2013.01); *B65H 3/0661* (2013.01); *B65H 3/56* (2013.01); *B65H 2402/543* (2013.01); *B65H 2801/06* (2013.01)

(58) Field of Classification Search
CPC ..... B65H 3/5223; B65H 3/26; B65H 3/0661
See application file for complete search history.

(56) References Cited

U.S. PATENT DOCUMENTS 8,534,664 B2 * 9/2013 Yamamoto ..... B65H 3/5223 271/124
8,757,616 B2 * 6/2014 Arimura ..... B65H 3/5223 271/258.01
9,487,364 B2 * 11/2016 Kimura ..... B65H 3/56
9,868,601 B2 * 1/2018 Fujii ..... B65H 3/68
2018/0009614 A1 * 1/2018 Kawashima ..... B65H 7/02

FOREIGN PATENT DOCUMENTS

JP 1993170347 A 7/1993

* cited by examiner

*Primary Examiner* — Patrick Cicchino
(74) *Attorney, Agent, or Firm* — Alleman Hall Creasman & Tuttle LLP

(57) ABSTRACT

A sheet feed device includes a pair of sheet feed rollers, a pair of separation pads, and a first contact portion. The pair of sheet feed rollers are provided in alignment with an interval between them in a width direction perpendicular to a feeding direction in which sheets placed on a sheet placing portion are fed, and feed a sheet from the sheet placing portion. When an overlapping sheet overlaps under a target sheet that is in contact with the pair of sheet feed rollers, the pair of separation pads separate the overlapping sheet from the target sheet. The first contact portion is provided on the holder at a position between the pair of separation pads and projecting more than contact surfaces of the pair of separation pads, and comes in contact with the lower surface of the sheet.

4 Claims, 4 Drawing Sheets

SHEET FEED DEVICE FOR RESTRICTING NOISE GENERATION, IMAGE FORMING APPARATUS

INCORPORATION BY REFERENCE

This application is based upon and claims the benefit of priority from the corresponding Japanese Patent Application No. 2018-236956 filed on Dec. 19, 2018, the entire contents of which are incorporated herein by reference.

BACKGROUND

The present disclosure relates to: a sheet feed device for supplying sheets; and an image forming apparatus.

In a sheet feed device provided in an image forming apparatus such as a printer, a separation pad may be used to prevent a plurality of sheets from being fed, in a state of being overlapped with each other, from a sheet placing portion such as a sheet feed tray. In this type of sheet feed device, a friction between a sheet and the separation pad may cause the sheet to vibrate, and the vibration may generate a noise.

There is known a related technology in which two types of separation pads having different friction coefficients are disposed in alignment in a sheet conveyance direction so as to restrict the noise due to the friction between the sheet and the separation pads from being generated.

SUMMARY

A sheet feed device according to an aspect of the present disclosure includes a sheet placing portion, a lift plate, a pair of sheet feed rollers, a pair of separation pads, a holder, a first biasing member, and a first contact portion. A plurality of sheets are placed in the sheet placing portion. The lift plate is pivotably provided in the sheet placing portion to lift the sheets. The pair of sheet feed rollers are provided in alignment with an interval therebetween in a width direction perpendicular to a feeding direction in which the sheets are fed. The pair of sheet feed rollers feed a sheet from the sheet placing portion by contacting an upper surface of the sheet. The pair of separation pads are provided in alignment with an interval therebetween in the width direction and biased toward the pair of sheet feed rollers. When an overlapping sheet overlaps under a target sheet that is in contact with the pair of sheet feed rollers, the pair of separation pads separate the overlapping sheet from the target sheet by coming in contact with a lower surface of the overlapping sheet. The holder supports the pair of separation pads and is provided in such a way as to move in a facing direction in which the pair of separation pads approach and separate from the pair of sheet feed rollers. The first biasing member biases the holder toward the pair of sheet feed rollers. The first contact portion is provided on the holder at a position between the pair of separation pads and projecting more than contact surfaces of the pair of separation pads that come in contact with a lower surface of the sheet fed by the pair of sheet feed rollers. The first contact portion comes in contact with the lower surface of the sheet fed by the pair of sheet feed rollers.

An image forming apparatus according to another aspect of the present disclosure includes the sheet feed device, and an image forming portion. The image forming portion forms an image on a sheet fed by the sheet feed device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 100]

Figure 1:
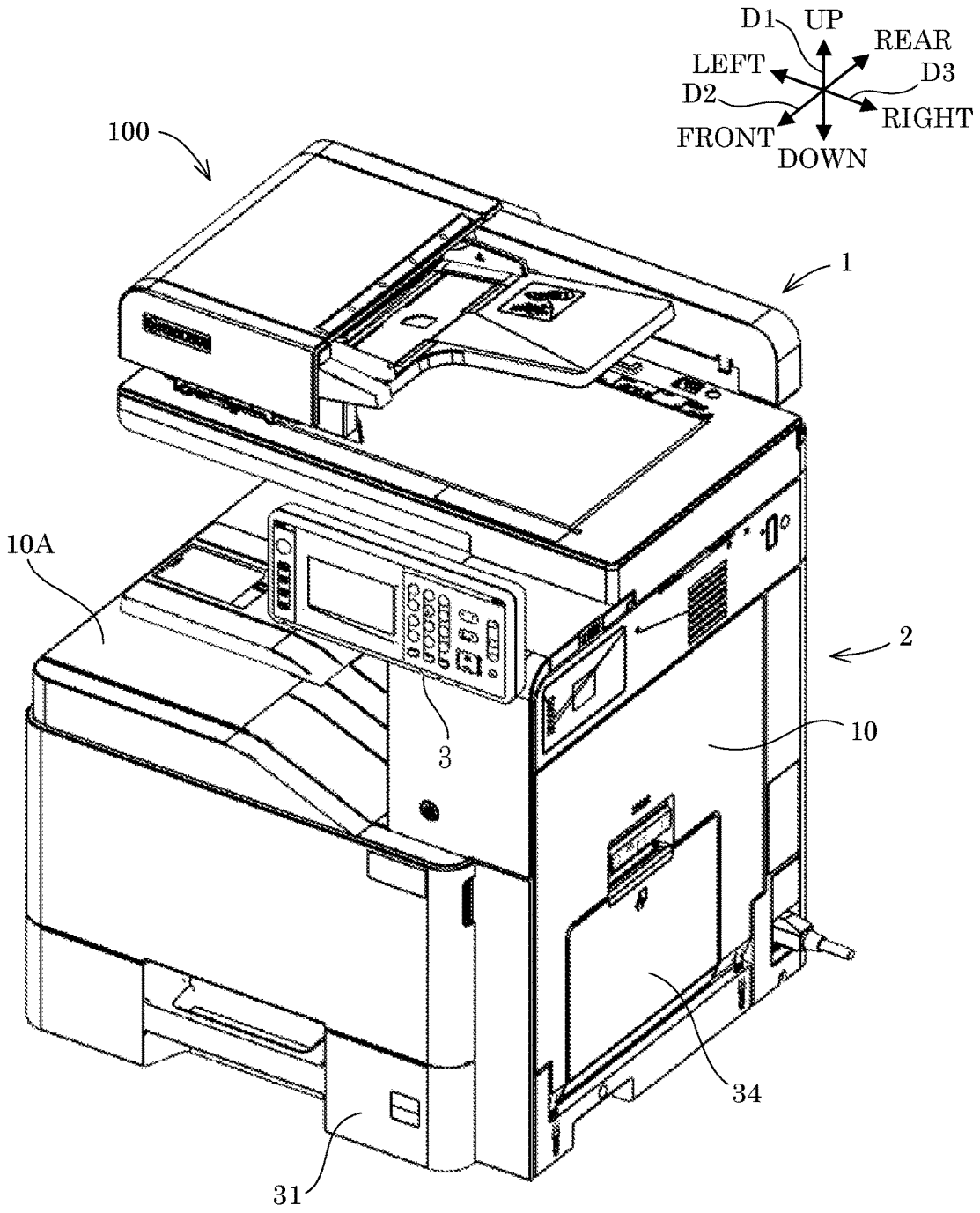
FIG. 1 is a perspective diagram showing a configuration of an image forming apparatus according to an embodiment of the present disclosure.

First, a description is given of a configuration of an image forming apparatus 100 according to an embodiment of the present disclosure with reference to FIG. 1.

For the sake of explanation, an up-down direction D1 is defined as a vertical direction in a state where the image forming apparatus 100 is installed usably (the state shown in FIG. 1). In addition, a front-rear direction D2 is defined on the supposition that a left-near side of the image forming apparatus 100 shown in FIG. 1 is a front side (front). Furthermore, a left-right direction D3 is defined based on the image forming apparatus 100 in the installation state viewed from the front side.

The image forming apparatus 100 is a multifunction peripheral having a plurality of functions such as a scan function for reading image data from a document sheet, a print function for forming an image based on image data, a facsimile function, and a copy function. It is noted that the present disclosure is applicable to image forming apparatuses such as a printer device, a facsimile device, and a copier.

As shown in FIG. 1, the image forming apparatus 100 includes an image reading portion 1, an image forming portion 2, and an operation/display portion 3.

The image reading portion 1 includes an automatic document feeder (ADF) that is configured to convey a document sheet placed on a document sheet placing portion to a sheet discharge portion. The image reading portion 1 also includes a document sheet table on which a document sheet is placed. The image reading portion 1 is configured to read image data from a document sheet conveyed by the automatic document feeder, or from a document sheet placed on the document sheet table.

The image forming portion 2 is configured to form an image on a sheet by an electrophotographic method based on image data read by the image reading portion 1. In addition, the image forming portion 2 is configured to form an image on a sheet based on image data input from an external information processing apparatus. It is noted that the image forming portion 2 may form an image on a sheet by another image forming method such as an inkjet method.

The operation/display portion 3 includes a display portion that is, for example, a liquid crystal display and displays various types of information in response to control instructions from a control portion (not shown). The operation/display portion 3 also includes an operation portion that is composed of, for example, operation keys or a touch panel through which various types of information are input to the control portion in response to user operations.

[Configuration of Image Forming Portion 2]

Next, a configuration of the image forming portion 2 is described with reference to FIG. 1 to FIG. 3.

Figure 2:
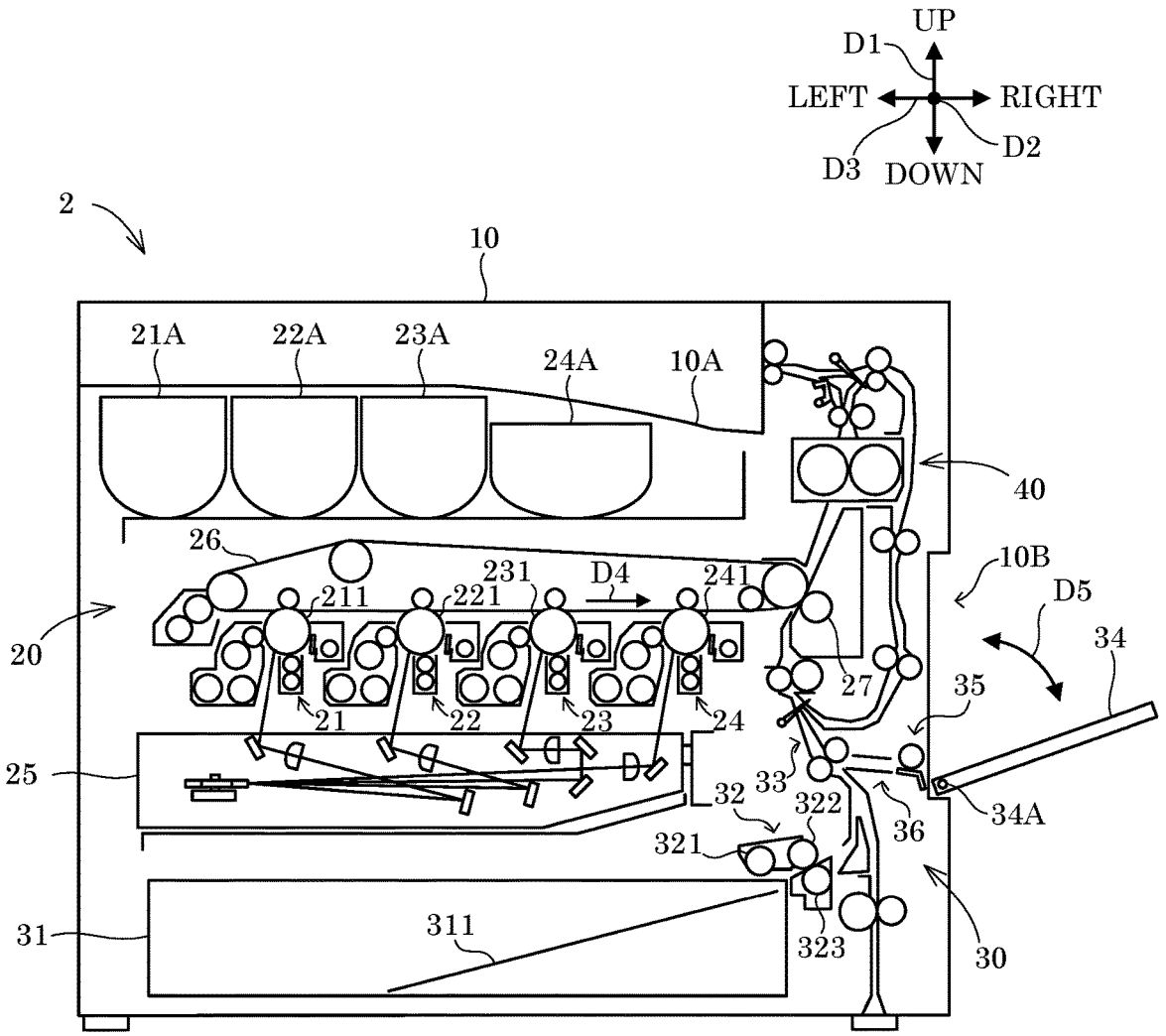
FIG. 2 is a cross-sectional diagram showing a configuration of the image forming apparatus according to the embodiment of the present disclosure.

As shown in FIG. 1 and FIG. 2, the image forming portion 2 includes a housing 10, a toner image transfer portion 20, a sheet feed portion 30, and a fixing portion 40.

The housing 10 stores the components of the image forming portion 2. The housing 10 is formed in an approximate shape of a rectangular parallelepiped. As shown in FIG. 1 and FIG. 2, a sheet receiving portion 10A is formed in an upper portion of the housing 10. A sheet with an image formed thereon by the image forming portion 2 is discharged onto the sheet receiving portion 10A. In addition, as shown in FIG. 2, an opening portion 10B is formed in a right side portion of the housing 10. The opening portion 10B is opened and closed by a manual feed tray 34 shown in FIG. 1 and FIG. 2.

As shown in FIG. 2, the toner image transfer portion 20 includes image forming units 21 to 24, a laser scanning unit (LSU) 25, an intermediate transfer belt 26, and a secondary transfer roller 27.

The image forming units 21 to 24 are arranged in line in a movement direction D4 (see FIG. 2) in which the intermediate transfer belt 26 moves. As shown in FIG. 2, the image forming units 21, 22, 23, and 24 respectively include photoconductor drums 211, 221, 231, and 241 that correspond to a plurality of colors. Specifically, the image forming unit 21 includes the photoconductor drum 211 that corresponds to Y (yellow). The image forming unit 22 includes the photoconductor drum 221 that corresponds to M (magenta). The image forming unit 23 includes the photoconductor drum 231 that corresponds to C (cyan). The image forming unit 24 includes the photoconductor drum 241 that corresponds to K (black).

The image forming unit 21 further includes a charging device, a developing device, a primary transfer roller, and a cleaning device in correspondence with the photoconductor drum 211. The charging device charges the surface of the photoconductor drum 211 to a certain potential. The developing device develops, with toner, an electrostatic latent image that is formed on the photoconductor drum 211 by the laser scanning unit 25. The primary transfer roller transfers a toner image that is formed on the photoconductor drum 211 by the developing device, to the intermediate transfer belt 26. The cleaning device cleans the surface of the photoconductor drum 211 after the toner image is transferred therefrom. It is noted that since the image forming units 22 to 24 are configured similar to the image forming unit 21, description thereof is omitted here.

Toner containers 21A, 22A, 23A, and 24A (see FIG. 2) storing toner of the colors corresponding to the photoconductor drums 211, 221, 231, and 241 are attached to the housing 10 in a detachable manner. The toner container 21A supplies the toner to the developing device of the image forming unit 21. Similarly, the toner containers 22A to 24A supply the toner of corresponding colors to the developing devices of the image forming units 22 to 24, respectively.

The laser scanning unit 25 scans the photoconductor drums 211, 221, 231, and 241 with light based on image data. This allows an electrostatic latent image to be formed on the peripheral surface of each of the photoconductor drums 211, 221, 231, and 241 based on the image data.

The intermediate transfer belt 26 is disposed above the photoconductor drums 211, 221, 231, and 241 so as to be in contact with the photoconductor drums 211, 221, 231, and 241. The intermediate transfer belt 26 is stretched by a driving roller and a plurality of stretching rollers. The intermediate transfer belt 26 moves in the movement direction D4 shown in FIG. 2 when the driving roller is driven to rotate by a rotational driving force supplied from a motor (not shown). Toner images of the respective colors formed on the photoconductor drums 211, 221, 231, and 241 are overlaid on the intermediate transfer belt 26 in sequence, thereby being transferred thereto.

The secondary transfer roller 27 transfers the toner images of the respective colors from the intermediate transfer belt 26 to a sheet supplied from the sheet feed portion 30.

The sheet feed portion 30 supplies a sheet to the toner image transfer portion 20. As shown in FIG. 1 and FIG. 2, the sheet feed portion 30 includes a sheet feed cassette 31, a first sheet feed unit 32, a first conveyance path 33, a manual feed tray 34 (an example of a sheet placing portion of the present disclosure), a second sheet feed unit 35, and a second conveyance path 36. A device including the manual feed tray 34 and the second sheet feed unit 35 is an example of a sheet feed device of the present disclosure.

The sheet feed cassette 31 stores sheets on which images are to be formed by the image forming portion 2. As shown in FIG. 1 and FIG. 2, the sheet feed cassette 31 is provided in a bottom portion of the housing 10. For example, the sheets stored in the sheet feed cassette 31 are sheet-like materials such as sheets of paper, sheets of coated paper, postcards, envelopes, and OHP sheets. The sheet feed cassette 31 includes a lift plate 311 for lifting a plurality of sheets stored therein.

The first sheet feed unit 32 feeds the sheets stored in the sheet feed cassette 31 one by one to the first conveyance path 33. The first sheet feed unit 32 includes a pickup roller 321, a sheet feed roller 322, and a retard roller 323. The pickup roller 321 feeds a top sheet among the plurality of sheets lifted by the lift plate 311 of the sheet feed cassette 31, to the sheet feed roller 322 by rotating while in contact with an upper surface of the top sheet. The sheet feed roller 322 feeds the sheet fed by the pickup roller 321 to the first conveyance path 33 by rotating while in contact with the upper surface of the sheet. The retard roller 323 is disposed below the sheet feed roller 322 and biased toward the sheet feed roller 322. When a plurality of overlapping sheets are fed by the pickup roller 321, the retard roller 323 separates sheets other than the top sheet from the plurality of overlapping sheets.

The first conveyance path 33 is a path in which a sheet moves from the sheet feed cassette 31 to the sheet receiving portion 10A. A plurality of conveyance rollers are provided in the first conveyance path 33. In addition, the secondary transfer roller 27 and the fixing portion 40 are provided in the first conveyance path 33. In the first conveyance path 33, a sheet that was fed from the sheet feed cassette 31 by the first sheet feed unit 32 is conveyed toward the sheet receiving portion 10A. The first conveyance path 33 is formed by a pair of conveyance guide members provided in the housing 10.

A sheet(s) on which an image is to be formed by the image forming portion 2 is placed on the manual feed tray 34. The manual feed tray 34 is formed in an approximate shape of a flat, rectangular parallelepiped, and is hollow inside. The manual feed tray 34 is provided in such a way as to open and close the opening portion 10B. Specifically, the manual feed tray 34 includes a rotation shaft 34A (see FIG. 2) that projects outward in the front-rear direction D2 from opposite ends of the manual feed tray 34 in the front-rear direction D2. The rotation shaft 34A is rotatably supported by bearings (not shown) provided in the opening portion 10B. This allows the manual feed tray 34 to pivot in a rotation direction D5 (see FIG. 2) around the rotation shaft 34A. The manual feed tray 34 pivots between a closing position (see FIG. 1) and an opening position (see FIG. 2), wherein when the manual feed tray 34 is located at the closing position, the opening portion 10B is closed, and when the manual feed tray 34 is located at the opening position, the opening portion 10B is opened. The manual feed tray 34 is configured to support a sheet(s) in a state where the manual feed tray 34 is located at the opening position.

Figure 3:
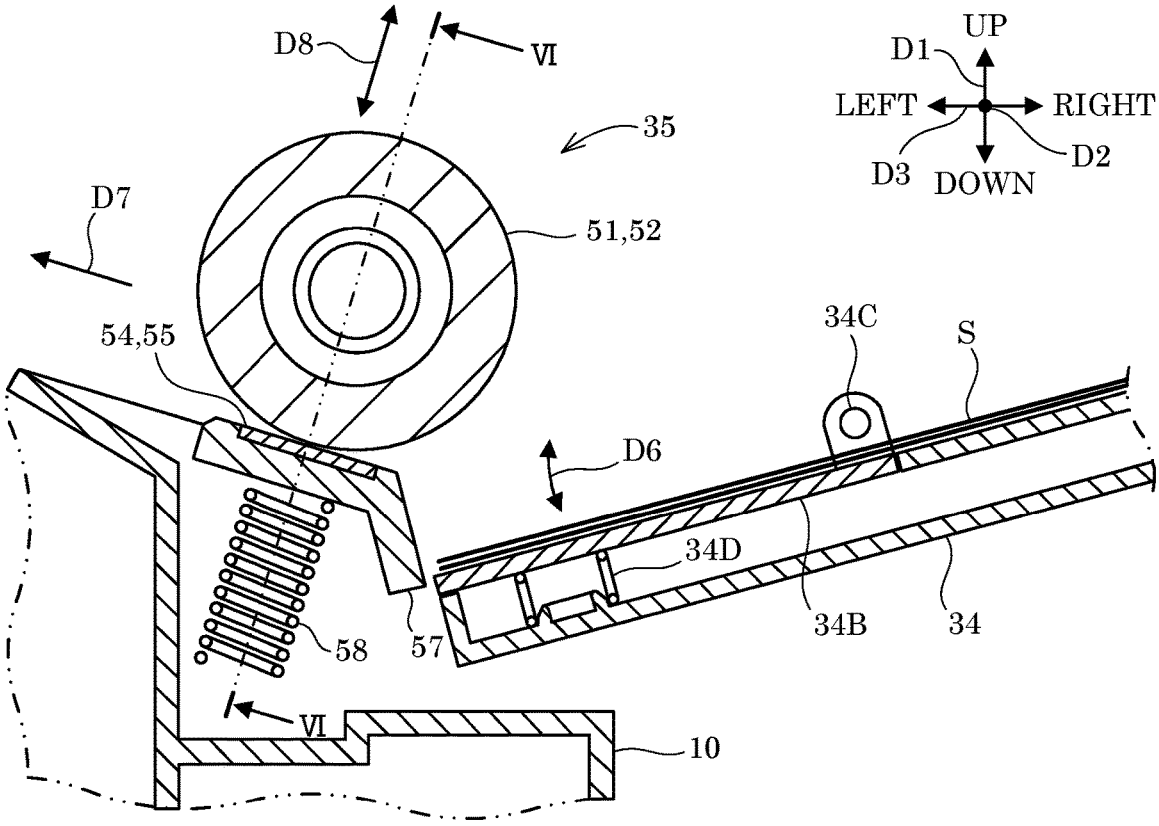
FIG. 3 is a cross-sectional diagram showing a configuration of a second sheet feed unit of the image forming apparatus according to the embodiment of the present disclosure.

As shown in FIG. 3, the manual feed tray 34 includes a lift plate 34B. The lift plate 34B is provided on the side of a pivot fulcrum of the manual feed tray 34. The lift plate 34B lifts one or more sheets S (see FIG. 3) placed on the manual feed tray 34. Specifically, the lift plate 34B includes a rotation shaft 34C (see FIG. 3) that projects outward in the front-rear direction D2 from opposite ends of the lift plate 34B in the front-rear direction D2. The rotation shaft 34C is rotatably supported by bearings (not shown) provided at opposite ends of the manual feed tray 34 in the front-rear direction D2. This allows the lift plate 34B to pivot in a pivot direction D6 (see FIG. 3) around the rotation shaft 34C.

As shown in FIG. 3, a compression coil spring 34D is provided between a bottom plate of the manual feed tray 34 and the lift plate 34B. The compression coil spring 34D elastically biases the lift plate 34B upward. The biasing force of the compression coil spring 34D allows the lift plate 34B to lift the one or more sheets S placed on the manual feed tray 34. In addition, the lift plate 34B moves downward when it is pressed by a lowering device (not shown) such as a cam mechanism or a solenoid.

The second sheet feed unit 35 feeds, one by one, the one or more sheets S (see FIG. 3) that are placed on the manual feed tray 34 and lifted by the lift plate 34B, to the second conveyance path 36. The configuration of the second sheet feed unit 35 is described below.

The second conveyance path 36 is a path in which a sheet moves from the manual feed tray 34 to the first conveyance path 33. In the second conveyance path 36, a sheet fed from the manual feed tray 34 by the second sheet feed unit 35 is conveyed toward the first conveyance path 33. The second conveyance path 36 is formed by a pair of conveyance guide members provided in the housing 10.

The fixing portion 40 fixes a toner image that was transferred to a sheet by the secondary transfer roller 27, to the sheet by heating the toner image. The sheet with the toner image fixed thereto is discharged to the sheet receiving portion 10A.

[Configuration of Second Sheet Feed Unit 35]

Figure 4:
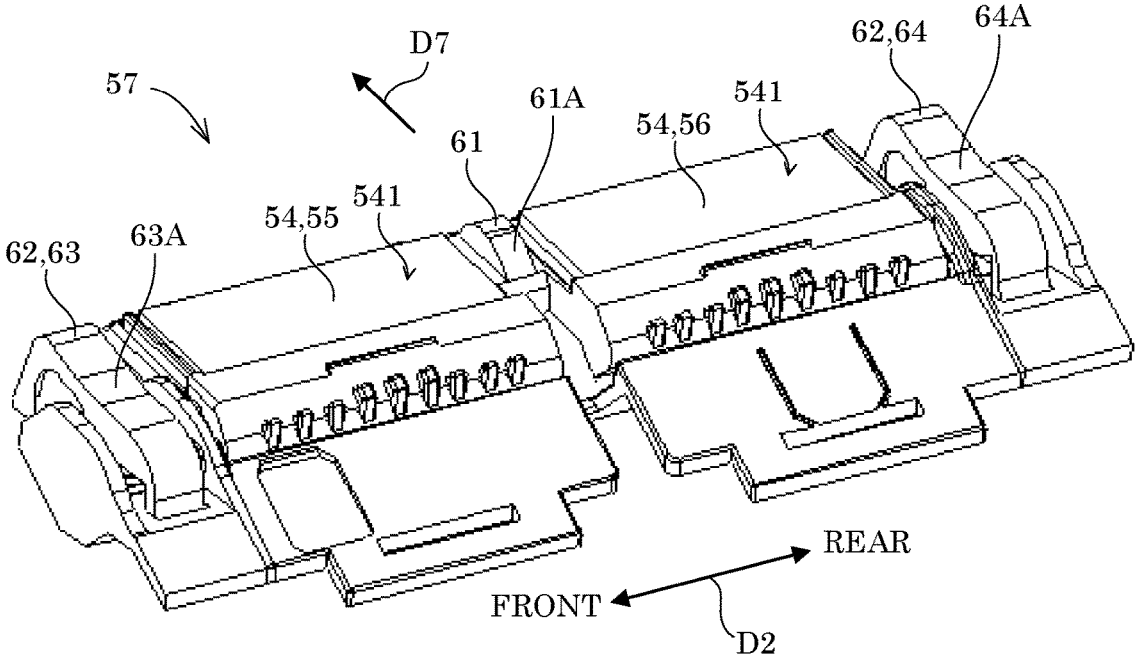
FIG. 4 is a perspective diagram showing a configuration of a pad holding portion of the image forming apparatus according to the embodiment of the present disclosure.
Figure 5:
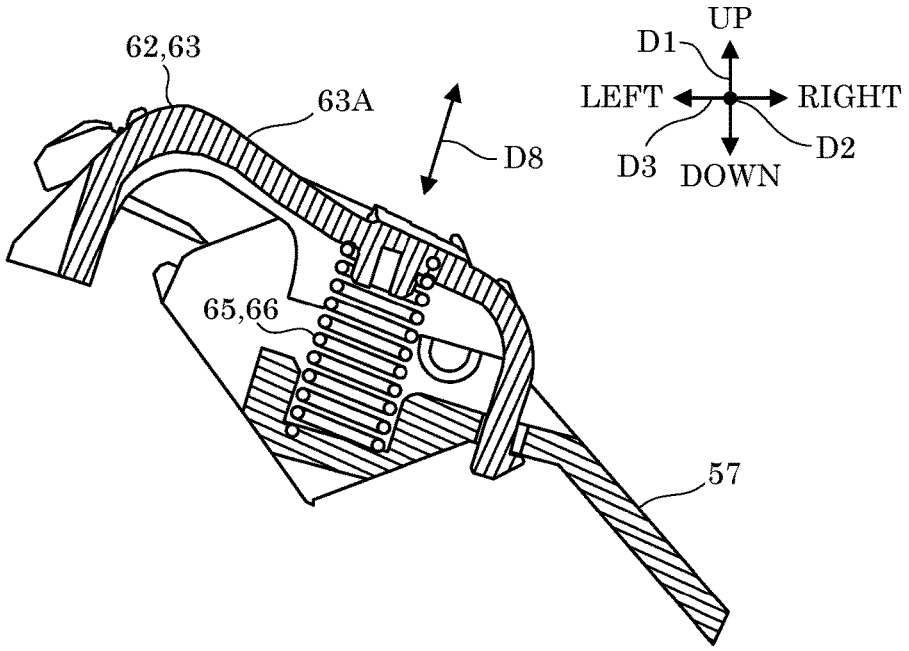
FIG. 5 is a cross-sectional diagram showing a configuration of a lateral contact portion of the image forming apparatus according to the embodiment of the present disclosure.
Figure 6:
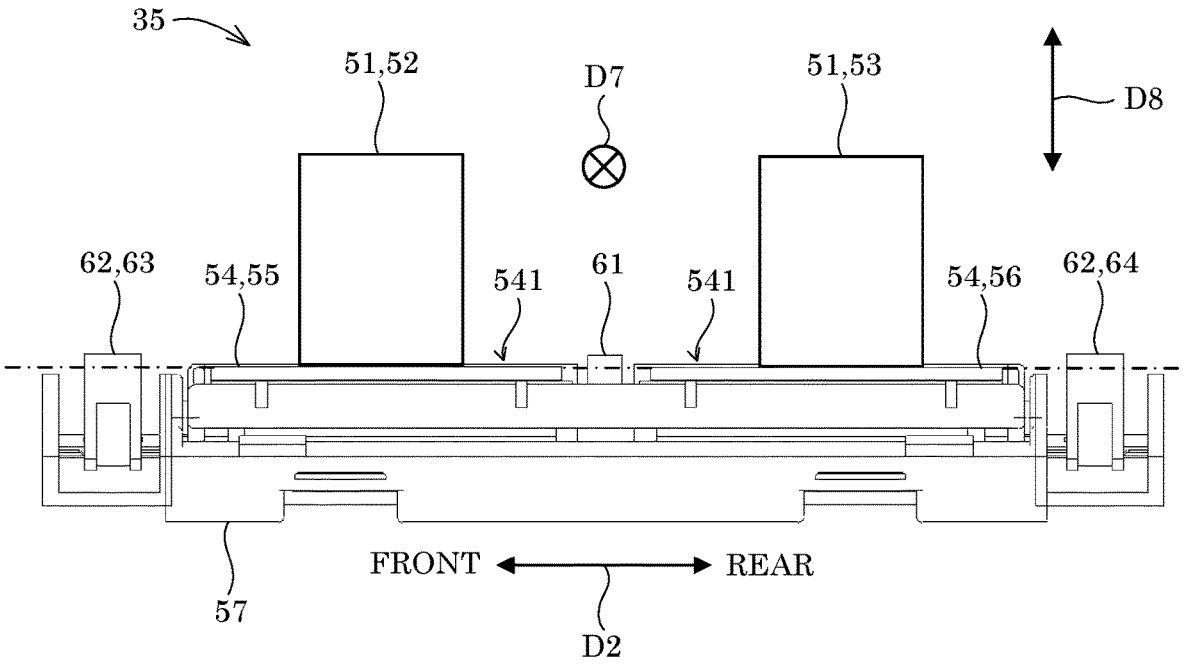
FIG. 6 is a cross-sectional diagram showing a configuration of the second sheet feed unit of the image forming apparatus according to the embodiment of the present disclosure.

Next, a description is given of a configuration of the second sheet feed unit 35 with reference to FIG. 3 to FIG. 6. Here, FIG. 6 is a cross-sectional diagram taken along a VI-VI line and viewed from the direction of arrows shown in FIG. 3. It is noted that the rotation shaft of a pair of sheet feed rollers 51 and hatching of cross-sections are omitted in FIG. 6.

As shown in FIG. 3 and FIG. 6, the second sheet feed unit 35 includes the pair of sheet feed rollers 51, a pair of separation pads 54, and a pad holding portion 57 (an example of a holder of the present disclosure). It is noted that FIG. 3 shows a sheet feed roller 52 that is one of the pair of sheet feed rollers 51 disposed on the front side. In addition, FIG. 3 shows a separation pad 55 that is one of the pair of separation pads 54 disposed on the front side.

As shown in FIG. 6, the pair of sheet feed rollers 51 are provided in alignment with an interval therebetween in the front-rear direction D2 (an example of a width direction of the present disclosure). For example, the pair of sheet feed rollers 51 are provided on both sides of a position that faces the center in the front-rear direction D2 of a sheet S fed from the manual feed tray 34 to the second conveyance path 36. The pair of sheet feed rollers 51 have a rotation shaft elongated in the front-rear direction D2, and are rotated around the rotation shaft by a rotational driving force supplied from a motor (not shown). The pair of sheet feed rollers 51 rotate while in contact with an upper surface of a top sheet of the one or more sheets S placed on the manual feed tray 34 and lifted by the lift plate 34B, thereby feeding the top sheet in a feeding direction D7 (see FIG. 7) perpendicular to the front-rear direction D2, from the manual feed tray 34.

As shown in FIG. 6, the pair of separation pads 54 are provided in alignment with an interval therebetween in the front-rear direction D2. The separation pad 55 that is one of the pair of separation pads 54 disposed on the front side is provided under the sheet feed roller 52 that is also disposed on the front side. In addition, a separation pad 56 that is the other one of the pair of separation pads 54 disposed on the rear side is provided under a sheet feed roller 53 that is the other one of the pair of sheet feed rollers 51 disposed on the rear side. As shown in FIG. 3, the pair of separation pads 54 are provided so as to face the pair of sheet feed rollers 51 at a position slightly on the left side of just below the pair of sheet feed rollers 51. In addition, the pair of separation pads 54 are disposed in an attitude where contact surfaces 541 thereof that contact the sheet are inclined upward toward the downstream side in the feeding direction D7. It is noted that the pair of separation pads 54 may be provided so as to face the pair of sheet feed rollers 51 at a position just below the pair of sheet feed rollers 51.

The pad holding portion 57 supports the pair of separation pads 54. The pad holding portion 57 is supported by the housing 10 so as to move in a facing direction D8 shown in FIG. 3. Here, the facing direction D8 is a direction in which the pair of sheet feed rollers 51 face the pair of separation pads 54. A compression coil spring 58 (an example of a first biasing portion of the present disclosure) is provided between the pad holding portion 57 and the housing 10. The pad holding portion 57 is biased by the compression coil spring 58 toward the pair of sheet feed rollers 51. This allows the pair of separation pads 54 to be biased from below the pair of sheet feed rollers 51 toward the pair of sheet feed rollers 51.

The pair of separation pads 54 are configured to, when a sheet (an overlapping sheet) overlaps under a sheet (target sheet) that is in contact with the pair of sheet feed rollers 51, separate the overlapping sheet from the target sheet by coming in contact with a lower surface of the overlapping sheet. That is, the pair of separation pads 54 separate the overlapping sheet from the target sheet by a frictional force acting between the pair of separation pads 54 and the overlapping sheet. This prevents a plurality of sheets from being fed, in a state of being overlapped with each other, from the manual feed tray 34.

Meanwhile, a friction between a sheet S and the pair of separation pads 54 may cause the sheet S to vibrate, and the vibration may generate a noise.

There is known a related technology in which two types of separation pads having different friction coefficients are disposed in alignment in the feeding direction D7 so as to restrict the noise due to the friction between the sheet and the separation pads from being generated.

However, in a sheet feed device according to the above-mentioned related technology, the configuration of the separation pads is complicated.

On the other hand, as described below, in the image forming apparatus 100 according to the embodiment of the present disclosure, the configuration of the pair of separation pads 54 is not complicated, and the noise due to the friction between the sheet and the pair of separation pads 54 is prevented from being generated.

Specifically, as shown in FIG. 4 to FIG. 6, the pad holding portion 57 includes an intermediate contact portion 61 (an example of a first contact portion of the present disclosure), a pair of lateral contact portions 62 (an example of a pair of second contact portions of the present disclosure), and a pair of compression coil springs 65 (an example of a pair of second biasing portions of the present disclosure). It is noted that FIG. 5 shows a lateral contact portion 63 that is one of the pair of lateral contact portions 62 disposed on the front side. In addition, the one-dot chain line shown in FIG. 6 indicates a position in the facing direction D8 at which the pair of sheet feed rollers 51 contact the pair of separation pads 54.

As shown in FIG. 4 and FIG. 6, the intermediate contact portion 61 is located between the pair of separation pads 54 and projects higher than the pair of separation pads 54. For example, the intermediate contact portion 61 is provided to project toward the pair of sheet feed rollers 51 at a position that faces the center in the front-rear direction D2 of a sheet S fed by the pair of sheet feed rollers 51. The intermediate contact portion 61 comes in contact with the lower surface of the sheet S fed by the pair of sheet feed rollers 51.

In a state where the sheet S is sandwiched by the pair of sheet feed rollers 51 and the pair of separation pads 54 at both sides of the center of the sheet S in the front-rear direction D2, the center of the sheet S is pressed upward by the intermediate contact portion 61. This allows an undulation waving in the front-rear direction D2 to be formed at the center of the sheet S in the front-rear direction D2, resulting in the sheet S having high stiffness. When the sheet S has high stiffness, vibration of the sheet S due to a friction between the lower surface of the sheet S and the pair of separation pads 54 is restricted. As a result, generation of noise due to the friction between the sheet S and the pair of separation pads 54 is restricted.

As shown in FIG. 4, the intermediate contact portion 61 includes an inclined surface 61A that is inclined upward in the feeding direction D7. The inclined surface 61A guides a front portion of the sheet S in the feeding direction D7 toward the pair of sheet feed rollers 51. With this configuration, an increase in conveyance resistance of the sheet S caused by the provision of the intermediate contact portion 61 is restricted.

As shown in FIG. 4 and FIG. 6, the pair of lateral contact portions 62 are located on both sides of the pair of separation pads 54 in the front-rear direction D2 and project higher than the pair of separation pads 54. For example, the pair of lateral contact portions 62 project from the pad holding portion 57 toward the pair of sheet feed rollers 51 in the facing direction D8 at two positions that are separated from the intermediate contact portion 61 by an equal interval. In addition, the pair of lateral contact portions 62 project toward the pair of sheet feed rollers 51 more than the intermediate contact portion 61. The pair of lateral contact portions 62 come in contact with the lower surface of the sheet S fed by the pair of sheet feed rollers 51. It is noted that the length of the projection of the pair of lateral contact portions 62 in the facing direction D8 may be equal to or smaller than that of the intermediate contact portion 61.

In the state where the sheet S is sandwiched by the pair of sheet feed rollers 51 and the pair of separation pads 54 at both sides of the center of the sheet S in the front-rear direction D2, two end portions of the sheet S at opposite ends in the front-rear direction D2 are pressed upward by the pair of lateral contact portions 62. This allows undulations waving in the front-rear direction D2 to be formed at the opposite ends in the front-rear direction D2 of the sheet S, resulting in the sheet S having high stiffness. As a result, generation of noise due to the friction between the sheet S and the pair of separation pads 54 is restricted.

As shown in FIG. 4, a lateral contact portion 63 that is one of the pair of lateral contact portions 62 disposed on the front side, includes an inclined surface 63A that is inclined upward in the feeding direction D7. The inclined surface 63A guides a front portion of the sheet S in the feeding direction D7 toward the pair of sheet feed rollers 51. In addition, as shown in FIG. 4, a lateral contact portion 64 that is the other one of the pair of lateral contact portions 62 disposed on the rear side, includes an inclined surface 64A that is inclined upward in the feeding direction D7. The inclined surface 64A guides a front portion of the sheet S in the feeding direction D7 toward the pair of sheet feed rollers 51. With this configuration, an increase in conveyance resistance of the sheet S caused by the provision of the pair of lateral contact portions 62 is restricted.

The pair of lateral contact portions 62 are supported by the pad holding portion 57 in such a way as to move in the facing direction D8 (see FIG. 5).

The pair of compression coil springs 65 elastically bias, toward the pair of sheet feed rollers 51 side in the facing direction D8, the pair of lateral contact portions 62 that are supported in such a way as to move in the facing direction D8. As shown in FIG. 5, a compression coil spring 66 that is one of the pair of compression coil springs 65 and provided on the front side in the front-rear direction D2 is located between the lateral contact portion 63 and the pad holding portion 57 provided on the front side, and elastically biases the lateral contact portion 63 toward the pair of sheet feed rollers 51. In addition, a compression coil spring 67 that is one of the pair of compression coil springs 65 and provided on the rear side in the front-rear direction D2 is located between the lateral contact portion 64 and the pad holding portion 57 provided on the rear side, and elastically biases the lateral contact portion 64 toward the pair of sheet feed rollers 51. With this configuration, an increase in conveyance resistance of the sheet S caused by the provision of the pair of lateral contact portions 62 is restricted.

It is noted that the pad holding portion 57 may not include the pair of compression coil springs 65. In addition, the pad holding portion 57 may include, in place of the pair of compression coil springs 65, an elastic member that is configured to bias the pair of lateral contact portions 62. In addition, the pad holding portion 57 may not include either or both of the lateral contact portions 63 and 64. In addition, the intermediate contact portion 61 and the pair of lateral contact portions 62 may be roller members that are supported in such a way as to be rotatable around an axis that extends in the front-rear direction D2.

In addition, the present disclosure may be applied to the sheet feed cassette 31 and the first sheet feed unit 32. That is, the first sheet feed unit 32 may be configured similar to the pair of sheet feed rollers 51, the pair of separation pads 54, and the pad holding portion 57, instead of including the pickup roller 321, the sheet feed roller 322, and the retard roller 323. In this case, the sheet feed cassette 31 is another example of the sheet placing portion of the present disclosure.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet feed device comprising:

a sheet placing portion in which a plurality of sheets are placed;

a lift plate pivotably provided in the sheet placing portion to lift the sheets;

a pair of sheet feed rollers provided in alignment with an interval therebetween in a width direction perpendicular to a feeding direction in which the sheets are fed, the pair of sheet feed rollers configured to feed a sheet from the sheet placing portion by contacting an upper surface of the sheet;

a pair of separation pads provided in alignment with an interval therebetween in the width direction and biased toward the pair of sheet feed rollers, the pair of separation pads configured to, when an overlapping sheet overlaps under a target sheet that is in contact with the pair of sheet feed rollers, separate the overlapping sheet from the target sheet by coming in contact with a lower surface of the overlapping sheet;

a holder provided in such a way as to move in a facing direction in which the pair of separation pads approach and separate from the pair of sheet feed rollers, the holder supporting the pair of separation pads;

a first biasing member configured to bias the holder toward the pair of sheet feed rollers;

a first contact portion provided on the holder at a position between the pair of separation pads and projecting more than contact surfaces of the pair of separation pads that come in contact with a lower surface of the sheet fed by the pair of sheet feed rollers, the first contact portion configured to come in contact with the lower surface of the sheet fed by the pair of sheet feed rollers;

a pair of second contact portions located on both sides of the pair of separation pads in the width direction and projecting more than the contact surfaces of the pair of separation pads, the pair of second contact portions configured to come in contact with the lower surface of the sheet fed by the pair of sheet feed rollers; and a pair of second biasing portions configured to elastically bias the pair of second contact portions toward the pair of sheet feed rollers side in the facing direction, wherein the pair of second contact portions are supported by the holder in such a way as to move in the facing direction.

2. The sheet feed device according to claim 1, wherein the first contact portion includes an inclined surface that is inclined upward toward the downstream side in the feeding direction, and guides a front portion of the sheet toward the pair of sheet feed rollers, and each of the pair of second contact portions includes an inclined surface that guides the front portion of the sheet toward the pair of sheet feed rollers.

3. The sheet feed device according to claim 1, wherein the pair of separation pads abut on the pair of sheet feed rollers in an attitude where the contact surfaces are inclined upward toward the downstream side in the feeding direction.

4. An image forming apparatus comprising:

the sheet feed device according to claim 1; and an image forming portion which forms an image on a sheet fed by the sheet feed device.

* * * * *